US007717511B2

(12) United States Patent
Huang

(10) Patent No.: US 7,717,511 B2
(45) Date of Patent: May 18, 2010

(54) STRUCTURE OF CHAIR CAPABLE OF BEING STACKED VERTICALLY AND HORIZONTALLY

(76) Inventor: Tsung-Chieh Huang, 235 Chung-Ho Box 8-24, Taipei (TW)

( * ) Notice: Subject to any disclaimer, the term of this patent is extended or adjusted under 35 U.S.C. 154(b) by 262 days.

(21) Appl. No.: 11/858,917

(22) Filed: Sep. 21, 2007

(65) Prior Publication Data

US 2009/0079235 A1 Mar. 26, 2009

(51) Int. Cl.
*A47C 3/04* (2006.01)

(52) U.S. Cl. ..... 297/239; 297/331

(58) Field of Classification Search ..... 297/313, 297/336, 239, 448.1, 450.1
See application file for complete search history.

(56) References Cited

U.S. PATENT DOCUMENTS 6,030,037 A * 2/2000 Ritch et al. ..... 297/239
6,742,839 B2 * 6/2004 Piretti ..... 297/239
2005/0264060 A1 * 12/2005 Cesaroni et al. ..... 297/239
2007/0222266 A1 * 9/2007 Lucci et al. ..... 297/331

* cited by examiner

*Primary Examiner*—Joseph F Edell

(57) ABSTRACT

A chair assembly capable of being stacked vertically and horizontally includes a frame assembled with a turnable seat, a backrest, and armrests; wherein the frame is comprised of two frontal supports and two rear supports; an assembling shaft is horizontally disposed within the frame for holding and allowing the seat to be turned, a positioning rod disposed parallel to the assembling shaft for allowing the seat to be turned upward or downward and keeping the seat upturned or downturned. The assembly and combination of the frame, the backrest, the armrests, and the turnable seat causes that the resulted chair is stacked both horizontally and vertically. Moreover, the disposition of hooks and slots at both sides of the frame further allow the chairs to be aligned and connected together in an orderly manner.

9 Claims, 24 Drawing Sheets

STRUCTURE OF CHAIR CAPABLE OF BEING STACKED VERTICALLY AND HORIZONTALLY

FIELD OF THE INVENTION

The invention relates to a chair assembly that allows chairs to be stacked vertically and horizontally.

DESCRIPTION OF PRIOR ART

Conventionally, chairs with unfoldable supports are usually put away for storage by stacking them either horizontally or vertically, and the chairs may only be stacked horizontally or vertically due to the limitation in related technologies. In other words, chairs that may be stacked horizontally cannot be stacked vertically, and vice versa. As a result, the chairs with unfoldable supports are restricted in regard to methods of storage, and also pose difficulty when it is necessary to store the chairs into different storage areas and physical spaces.

SUMMARY OF THE INVENTION

According to the invention, a chair assembly capable of being stacked vertically and horizontally is a structure that allows chairs to be stacked horizontally and vertically, the structure comprises: a frame, a turnable seat assembled with the frame, a backrest assembled with frontal supports of the frame, and armrests assembled with rear supports of the frame.

Wherein the frame is comprised of two frontal supports and two rear supports; an assembling shaft is horizontally disposed within the frame for holding and allowing the seat to be turned, a positioning rod is disposed parallel to the assembling shaft for allowing the seat to be turned upward or downward and keeping the seat upturned or downturned.

The assembly and combination of the frame, the backrest, the armrests, and the turnable seat allow the resulted chair to be stacked both horizontally and vertically. Moreover, the disposition of hooks and slots at both sides of the frame further allow the chairs to be aligned and connected together in an orderly manner, which not only permit the chairs to be deployed and stored conveniently with a simple structure, but also means anyone may arrange a large number of chairs in a cost-effective way.

BRIEF DESCRIPTION OF DRAWINGS

The structure and the technical means adopted by the present invention to achieve the above and other objectives can be best understood by referring to the following detailed description of the preferred embodiments and the accompanying diagrams, wherein.

DETAILED DESCRIPTION OF PREFERRED EMBODIMENTS

Figure 1:
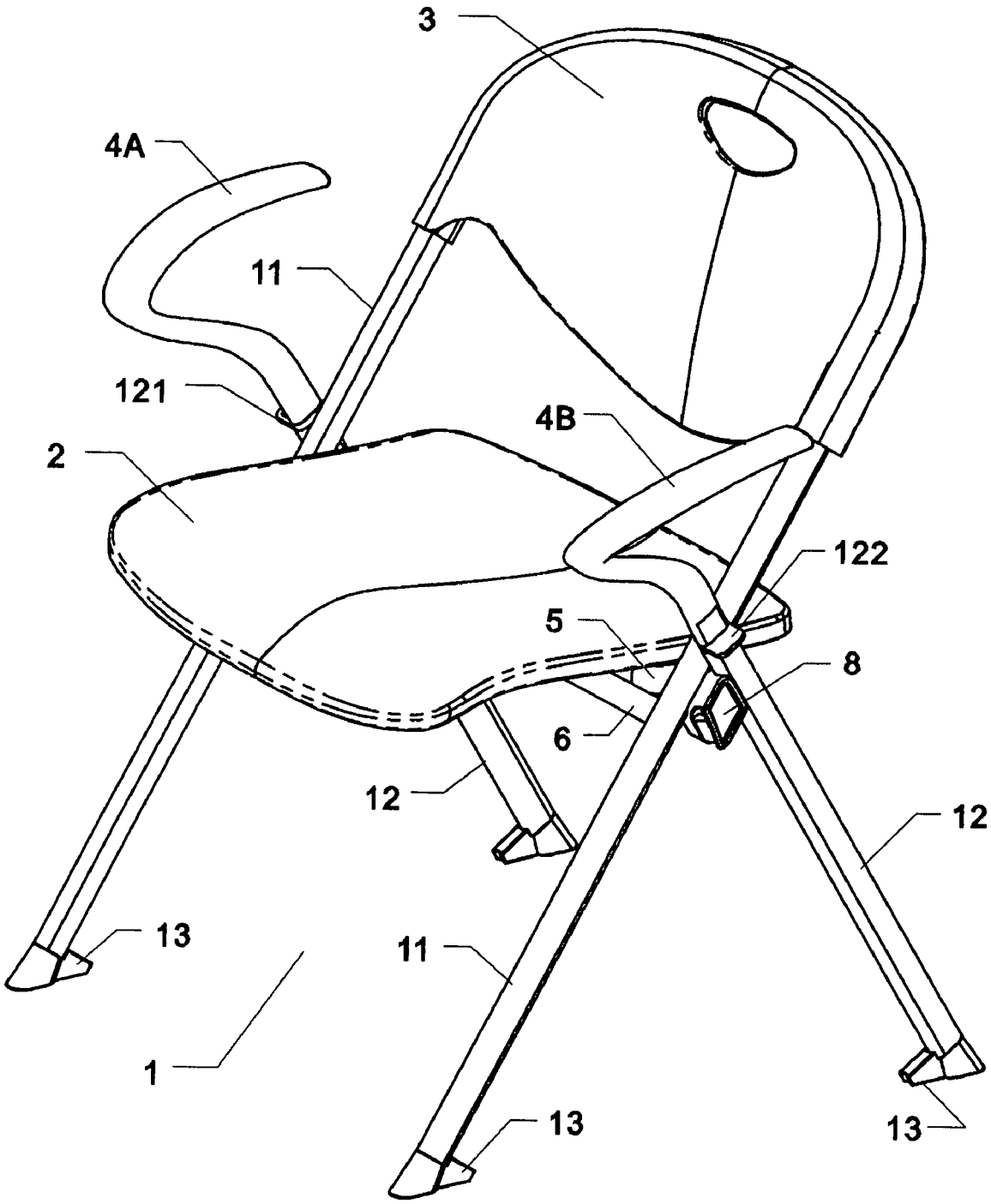
FIG. 1 is a preferred embodiment of the invention.
Figure 2:
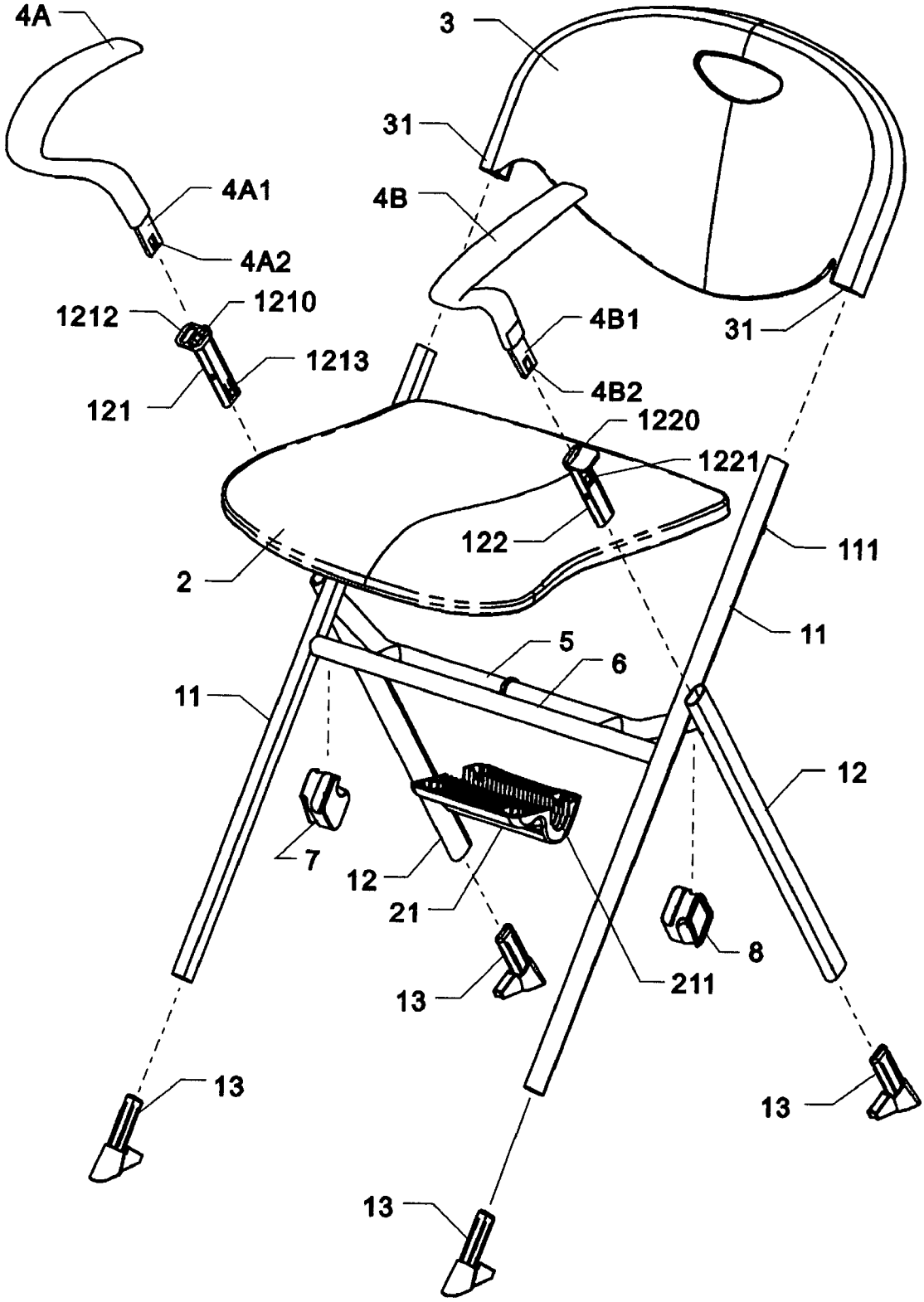
FIG. 2 is an exploded view that shows parts of a chair according to the invention.

Referring to FIGS. 1 and 2, which show a chair assembly capable of being stacked vertically and horizontally according to a preferred embodiment of the invention; the disclosed structure comprises a frame (1), a turnable seat (2) assembled with the frame (1), as well as a backrest (3) and armrests (4) assembled with the frame (1).

The frame (1) is resulted from combining two frontal supports (11) and two rear supports (12) together (as illustrated in FIGS. 14 to 17); a width between the two frontal supports (11) is smaller than a width between the two rear supports (12), and the frontal and the rear supports (11), (12) are disposed with stoppers (13) at bottom ends thereof, respectively; the stoppers (13) may include assembling openings (131) disposed at a bottom surface thereof (as indicated in FIGS. 74 to 78), and the assembling openings (131) may be disposed with screw threads therein for wheels to be assembled therewith selectively. An assembling shaft (5) is horizontally disposed in the frame (1) (such as between the two rear supports) so as to allow a seat (2) to be fixed thereto for turning; a positioning rod (6) is disposed parallel to the assembling shaft (5) in the frame (1) (such as between the two frontal supports), so that the seat (2) may be turned upward or downward and kept upturned or downturned. The seat (2) (as shown in FIGS. 62 to 67) and the assembling shaft (5) are assembled together via a seat turning mechanism (21), and the seat turning mechanism (21) includes a trough (211) (as shown in FIGS. 68 to 73) therein for receiving the assembling shaft (5) horizontally. The seat turning mechanism (21) is fixed underneath the seat (2), and the assembling shaft (5) is horizontally fitted into the trough (211) of the seat turning mechanism (21), so as to allow the seat (2) to be turned upward or downward with the assembling shaft (5) as the pivot point (upturned in FIGS. 3 and 4; downturned in FIGS. 5 and 6). The seat turning mechanism (21) also includes protruding stripes (212), (213) at an outer surface thereof, wherein a distance between a center of the trough (211) and an outer surface of the external protruding stripe (212) is greater than a distance between a center of the assembling shaft (5) and an outer surface of neighboring positioning rod (6), so that when the seat (2) is turned downward, it may be placed and held level. On the other hand, a distance between a center of the trough (211) and an outer surface of the external protruding stripe (213) is greater than a distance between a center of the assembling shaft (5) and an outer surface of neighboring positioning rod (6), so that when the seat (2) is turned upward, it may be positioned and secured firmly.

Figure 79:
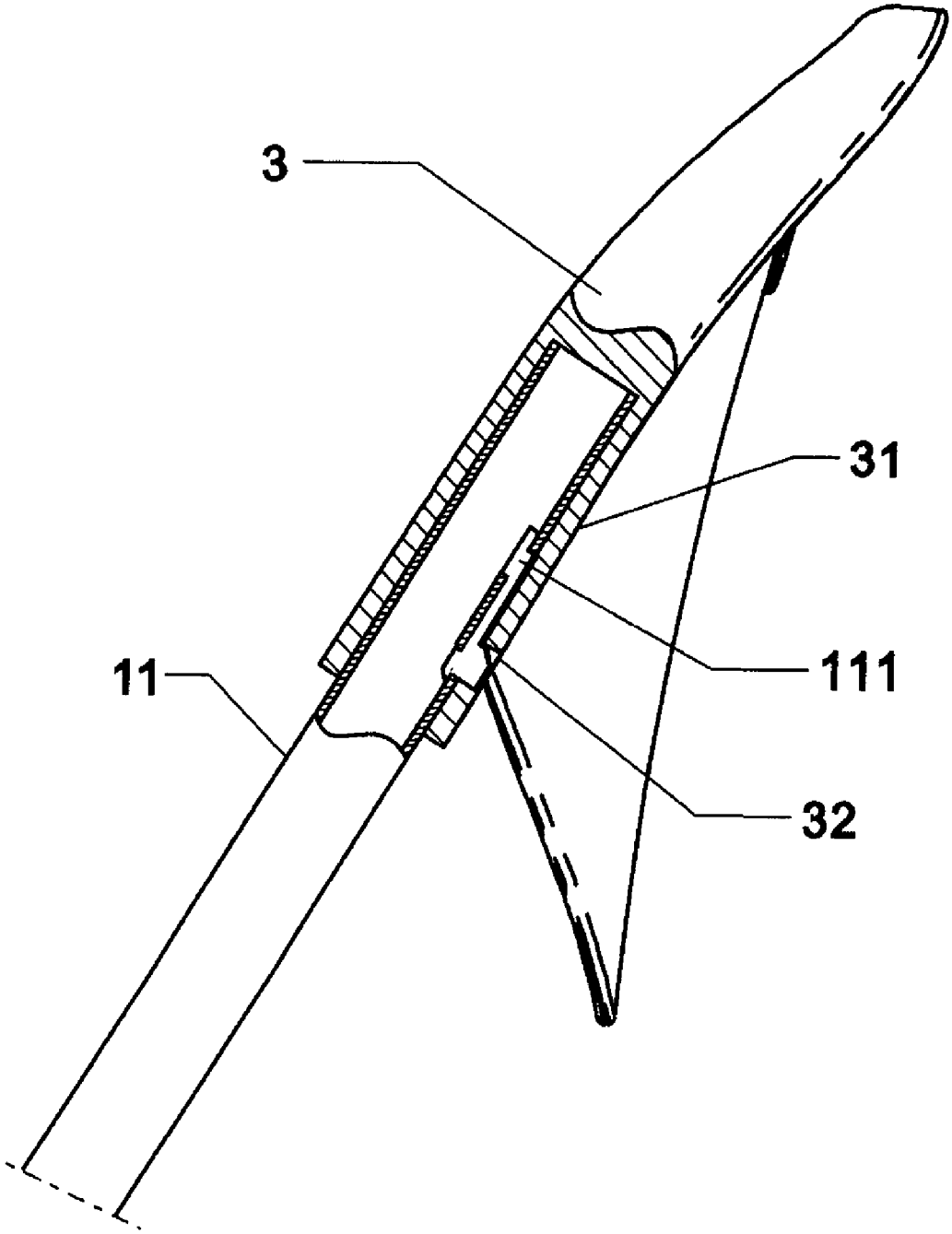
FIG. 79 is a schematic view that shows the assembly of the frontal support, the retaining component, and the backrest.

As indicated in FIG. 2, the frame (1) and the backrest (3) are assembled together via a retaining component (111), shown in FIGS. 18 to 21 disposed at a lateral side of an upper portion of the two frontal supports (11), respectively; whereas retaining holes (32) are disposed on two lateral tubes (31) of the backrest (3) for the retaining component (111) to fit into, as illustrated in FIGS. 22 to 27; so that when the backrest (3) is assembled with the two frontal supports (11) via the two lateral tubes (31), the retaining components (111) disposed on the two frontal supports (11) may be securely fitted into the retaining holes (32) of the backrest (3), thereby conveniently completing the assembly of the backrest (3) (as shown in FIG. 79).

Still referring to FIG. 2, the upper portions of the two rear supports (12) are respectively disposed with a left connecting component (121), as shown in FIGS. 37 to 41, and a right connecting component (122), as shown in FIGS. 52 to 56. The left and the right connecting components (121), (122) allow the left and the right armrests (4A), (4B) to assemble therewith; both the left and the right connecting components (121), (122) include a channel (1210) or (1220) at a center thereof for receiving the inserting parts (4A1), (4B1) of the left and the right armrests (4A), (4B), and the channels (1210) and (1220) include a retaining hole (1211), (1221) on a lateral hole thereof, respectively; for retaining a retaining part (4A2) on the inserting part (4A1) of the left armrest (4A) and a retaining part (4B2) on the inserting part (4B1) of the right armrest (4B). Moreover, a side of the left and the right connecting components (121), (122) has a respective retaining part (1213) or (1223) disposed on a side thereof for fitting into the rear supports (12) and facilitating the overall assembly of the chair, whereas the inserting parts (4A1), (4B1) of the left and the right armrests (4A) and (4B) are respectively disposed in lower openings (4A3), (4B3) of the left and the right armrests (4A) and (4B).

With respect to the left and the right connecting components (121), (122) at the left and the right side of the two rear supports (12), one of the connecting components such as the left connecting component (121) may comprise a slot (1212) at an outer side thereof, while another connecting component such as the right connecting component (122) may comprise a hook (1222) at an outer side thereof. The formation of the left and the right connecting components (121), (122) having the slot (1212) and the hook (1222) on the two rear supports (12) allows the chairs to be aligned and connected together horizontally in an orderly manner.

Figure 3:
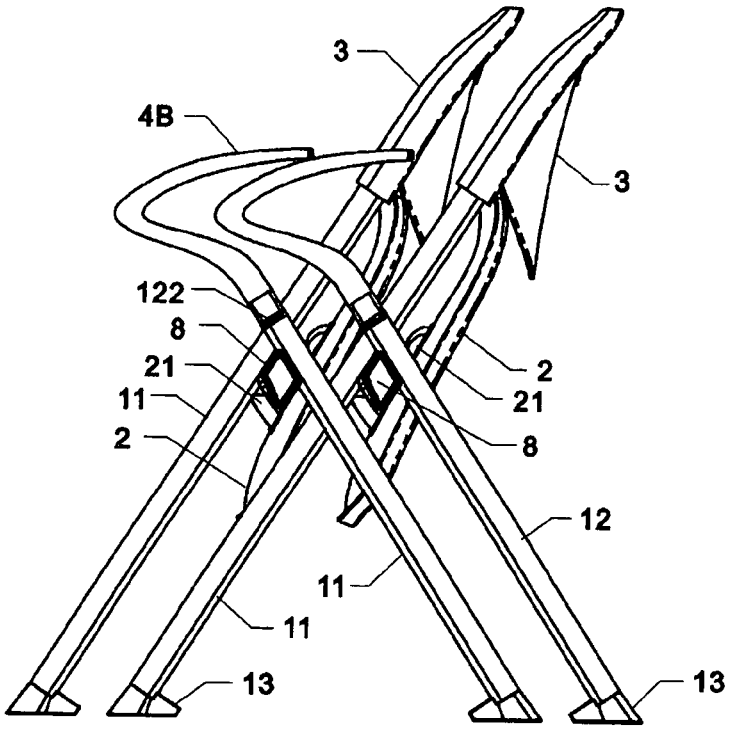
FIG. 3 is a lateral view that shows the chairs of the invention being stacked horizontally.
Figure 4:
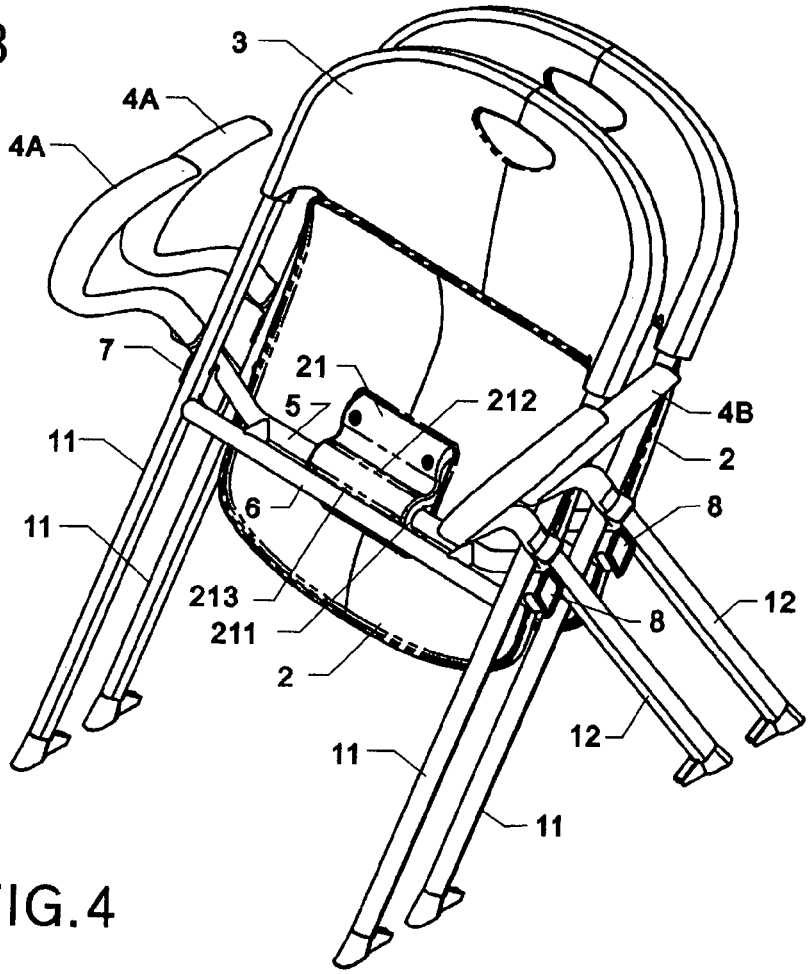
FIG. 4 is a three-dimensional view that shows the chairs of the invention being stacked horizontally.
Figure 5:
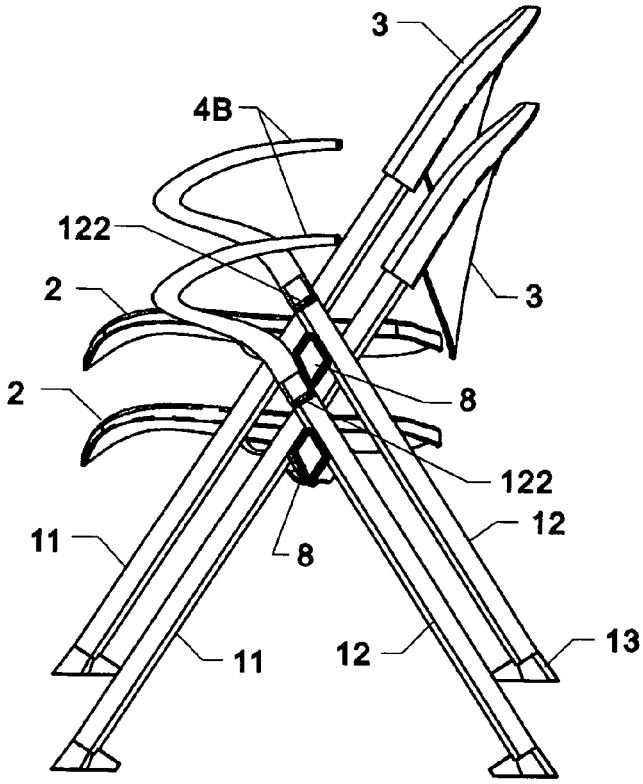
FIG. 5 is a lateral view that shows the chairs of the invention being stacked vertically.
Figure 6:
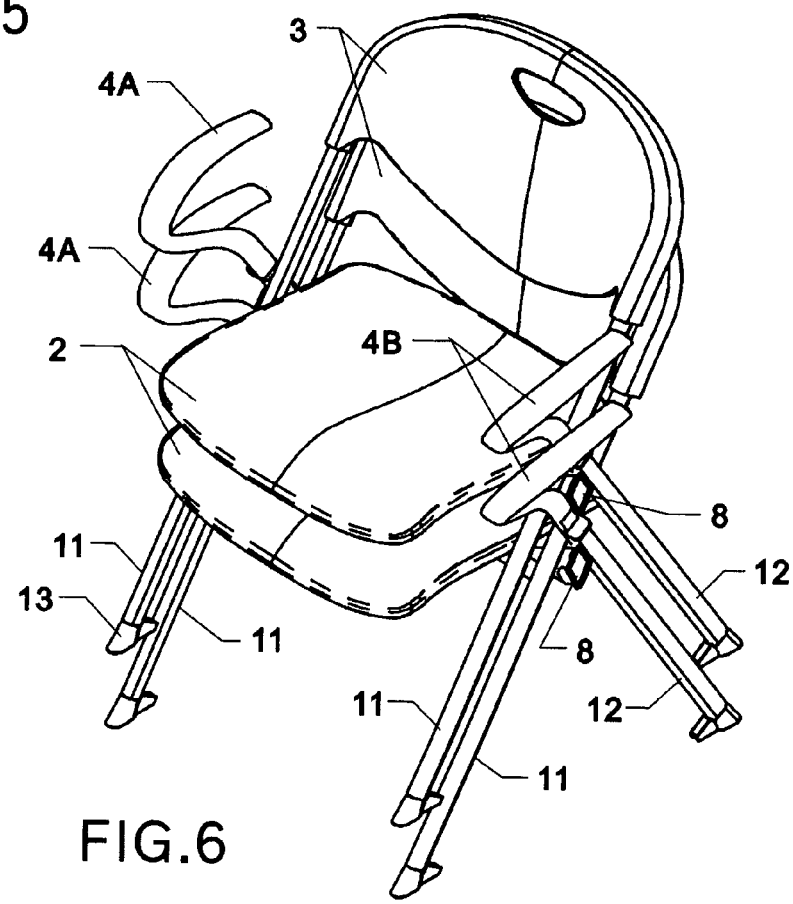
FIG. 6 is a three-dimensional view that shows the chairs of the invention being stacked vertically.
Figure 8:
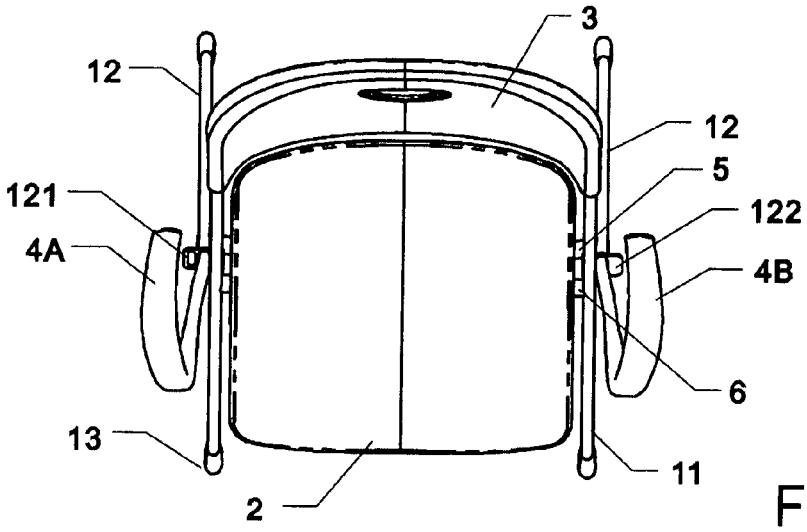
FIG. 8 is a top view of FIG. 7.
Figure 7:
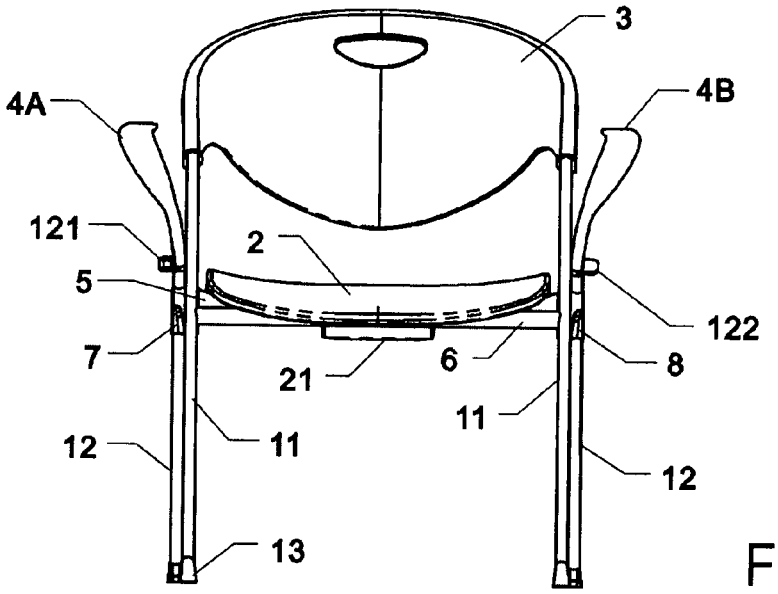
FIG. 7 is a front view that shows the chair of the invention.
Figure 9:
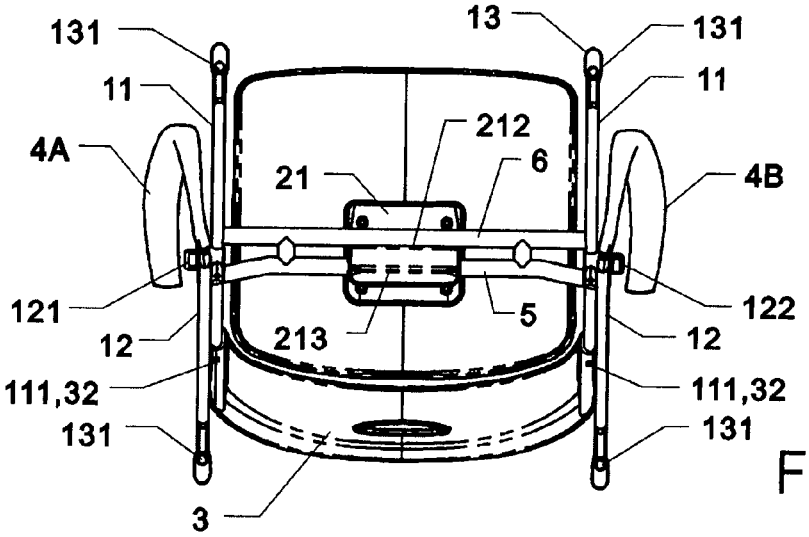
FIG. 9 is a bottom view of FIG. 7.
Figure 10:
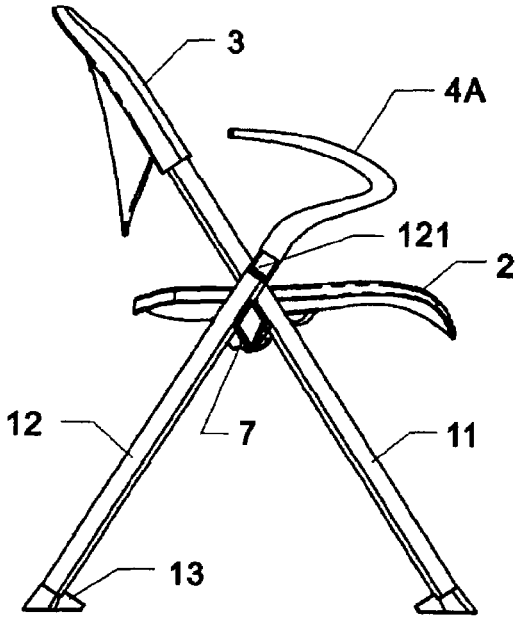
FIG. 10 is a left side view of FIG. 7.
Figure 11:
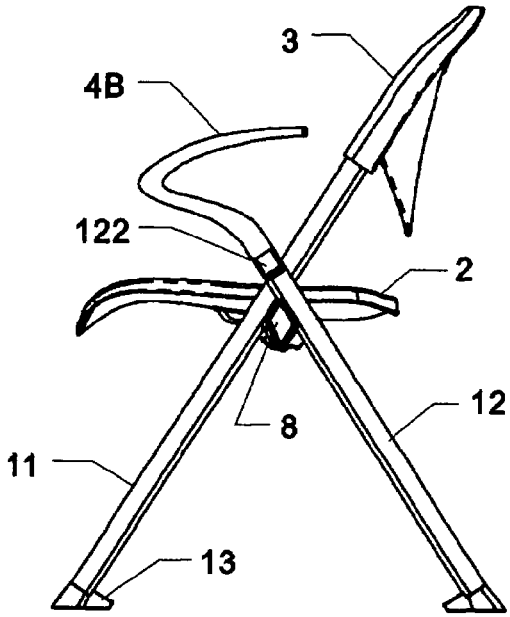
FIG. 11 is a right side view of FIG. 7.
Figure 12:
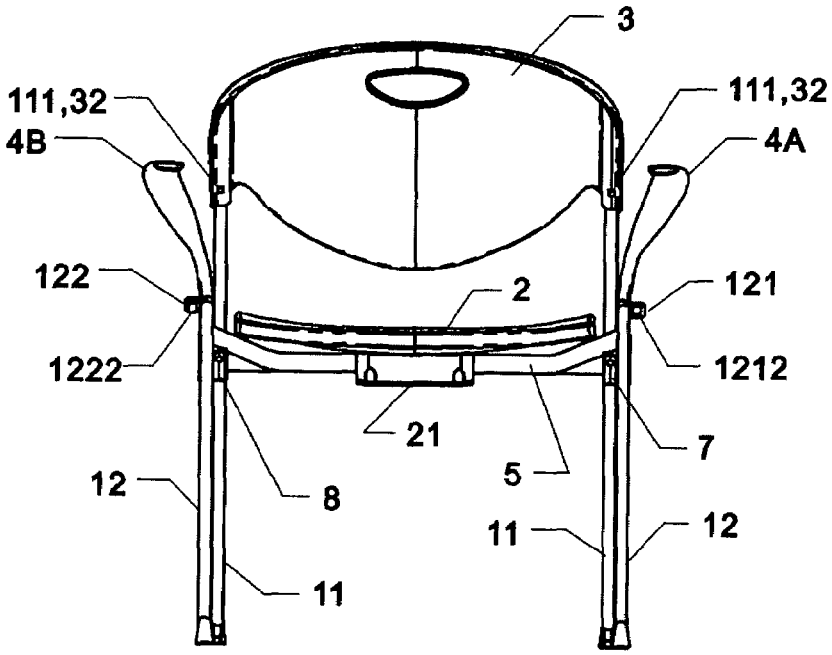
FIG. 12 is a rear view of FIG. 7.
Figure 13:
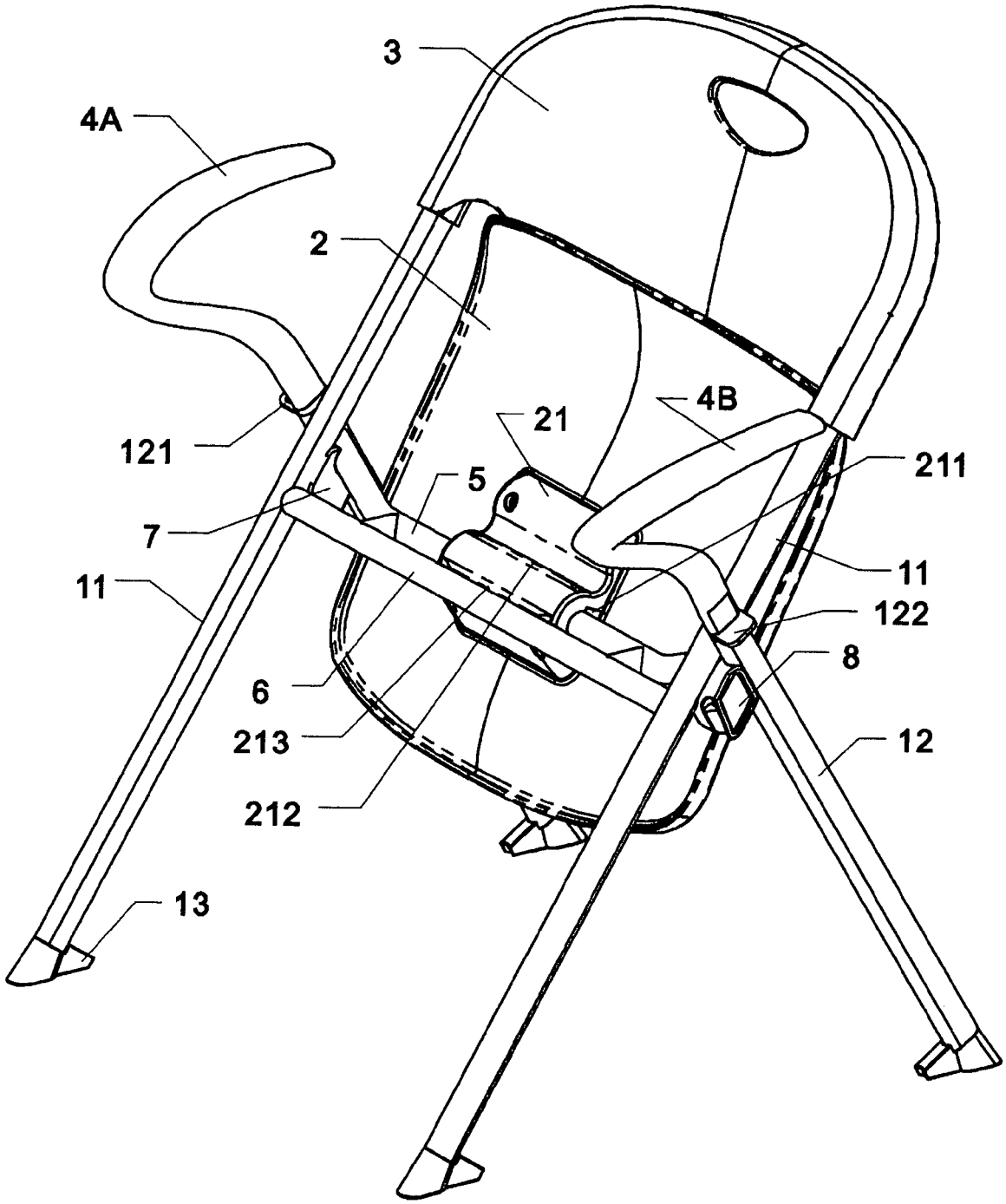
FIG. 13 is a schematic view that shows a seat of the chair of the invention is turned upward.
Figure 15:
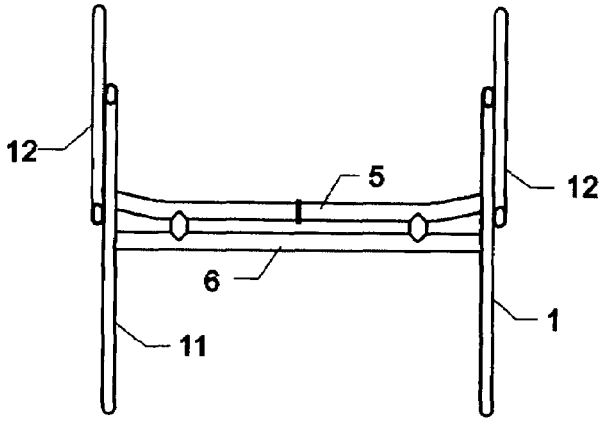
FIG. 15 is a top view of FIG. 14.
Figure 17:
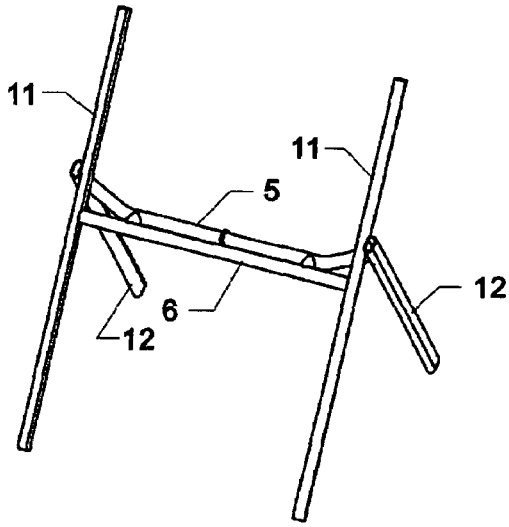
FIG. 17 is a three-dimensional view that shows the frame of the chair according to the invention.
Figure 14:
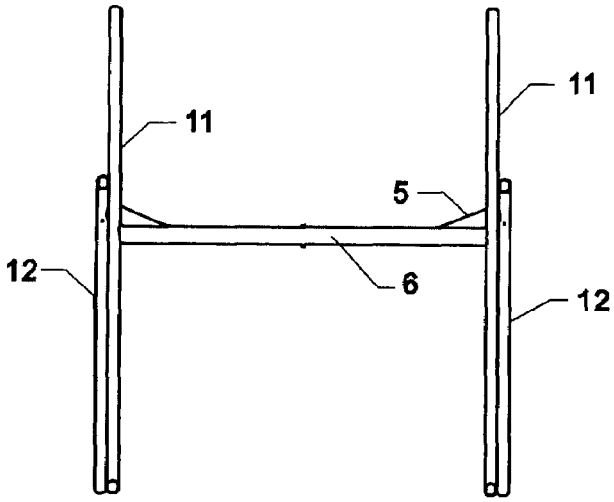
FIG. 14 is a front view that shows a frame of the chair according to the invention.
Figure 16:
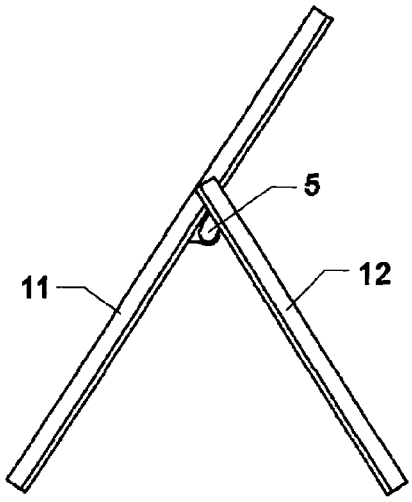
FIG. 16 is a right side view of FIG. 14.
Figure 20:
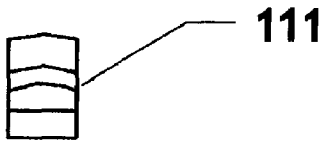
FIG. 20 is a top view of FIG. 18.
Figure 18:
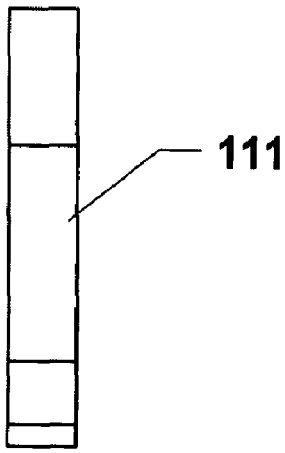
FIG. 18 is a front view that shows a retaining component of the chair according to the invention.
Figure 19:
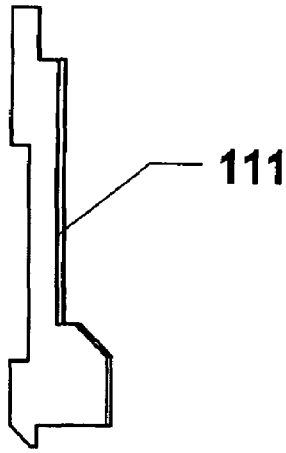
FIG. 19 is a right side view of FIG. 18.
Figure 21:
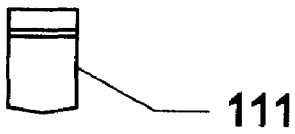
FIG. 21 is a bottom view of FIG. 18.
Figure 23:
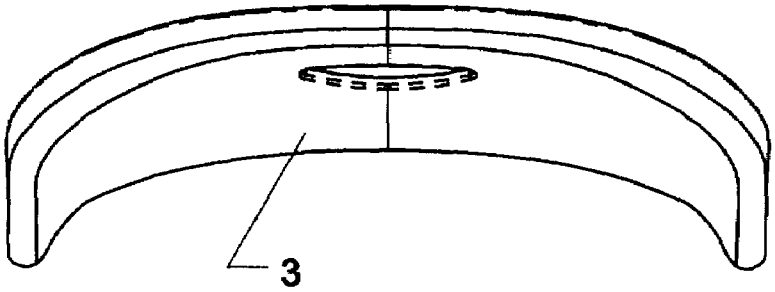
FIG. 23 is a top view of FIG. 22.
Figure 22:
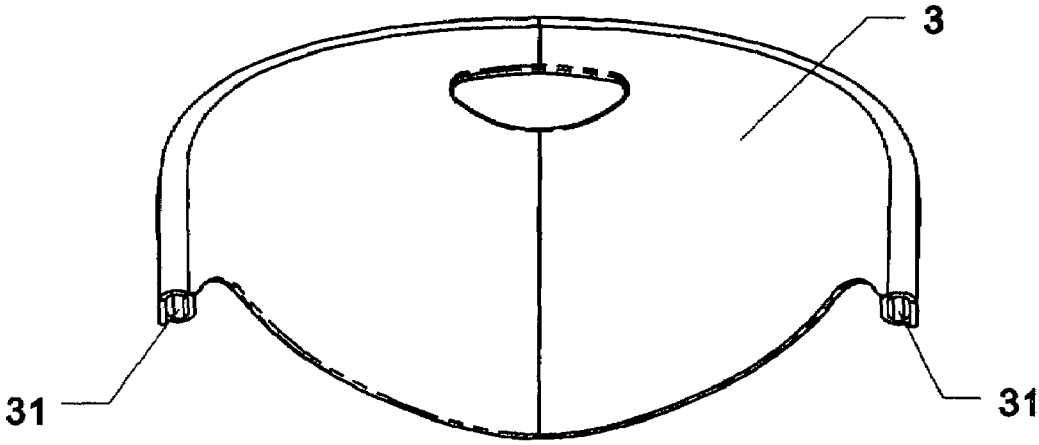
FIG. 22 is a schematic view that shows a backrest of the chair according to the invention.
Figure 24:
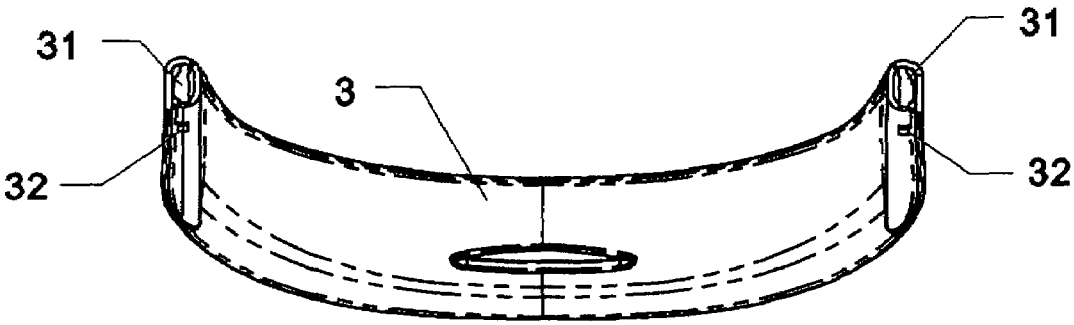
FIG. 24 is a bottom view of FIG. 22.
Figure 25:
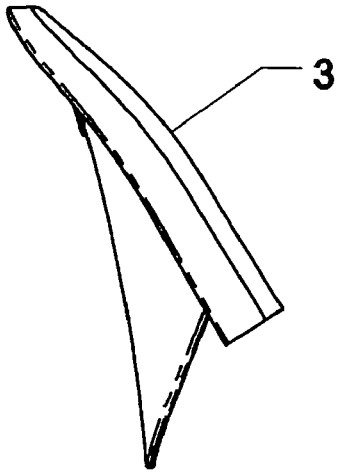
FIG. 25 is a left side view of FIG. 22.
Figure 26:
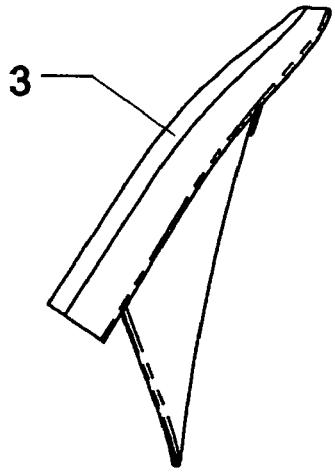
FIG. 26 is a right side view of FIG. 22.
Figure 27:
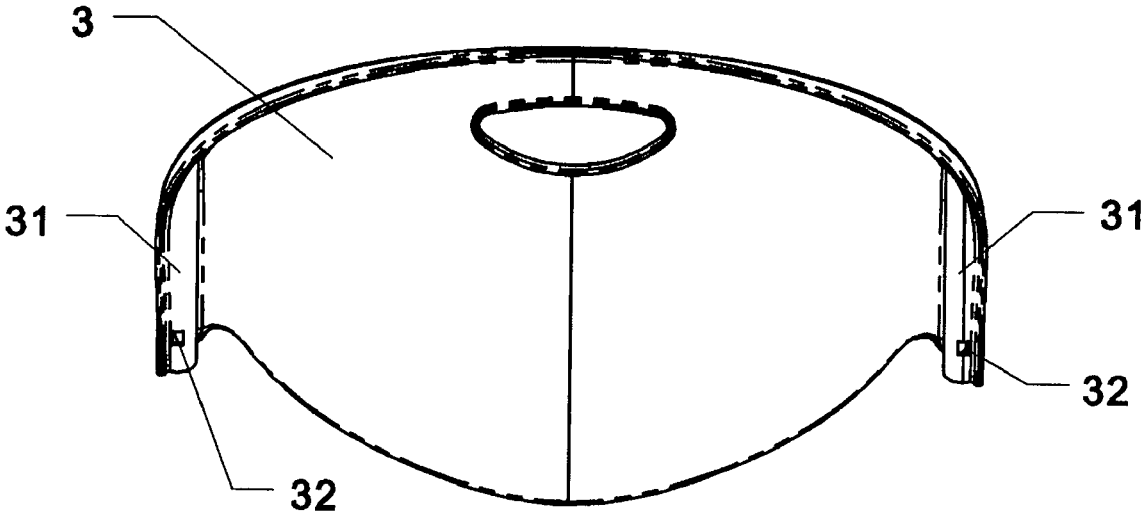
FIG. 27 is a rear view of FIG. 22.
Figure 31:
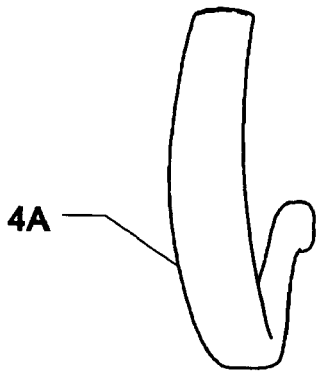
FIG. 31 is a top view of FIG. 28.
Figure 29:
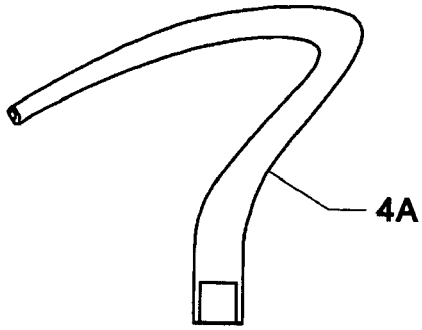
FIG. 29 is a left side view of FIG. 28.
Figure 28:
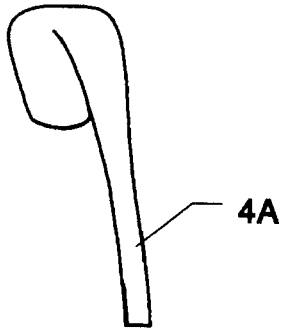
FIG. 28 is a schematic view that shows a left armrest of the chair according to the invention.
Figure 30:
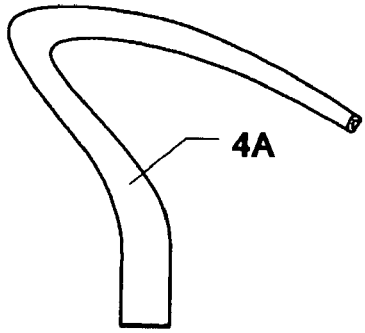
FIG. 30 is a right side view of FIG. 28.
Figure 32:
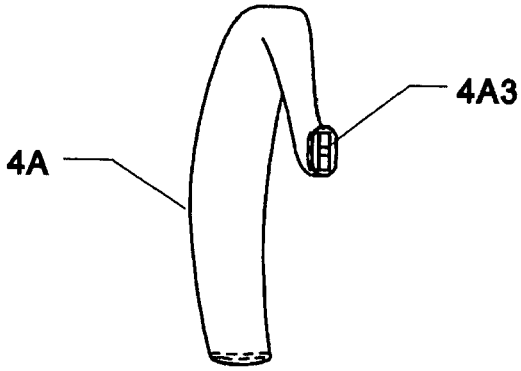
FIG. 32 is a bottom view of FIG. 28.
Figure 35:
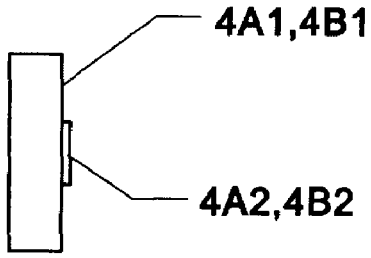
FIG. 35 is a top view of FIG. 33.
Figure 33:
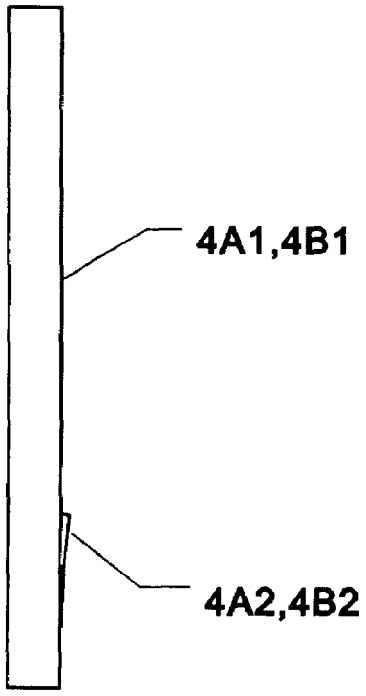
FIG. 33 is a schematic view that shows an inserting part of the armrest according to the invention.
Figure 34:
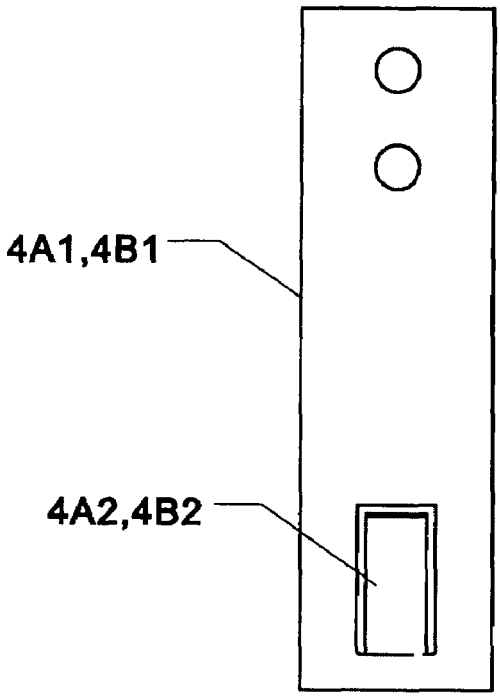
FIG. 34 is a right side view of FIG. 33.
Figure 36:
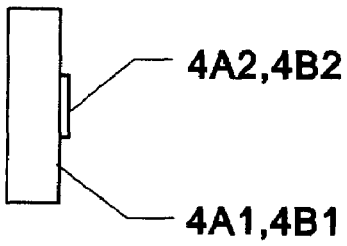
FIG. 36 is a bottom view of FIG. 33.
Figure 40:
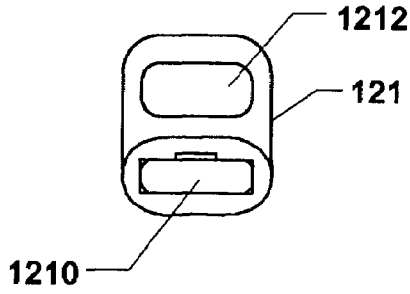
FIG. 40 is a top view of FIG. 37.
Figure 38:
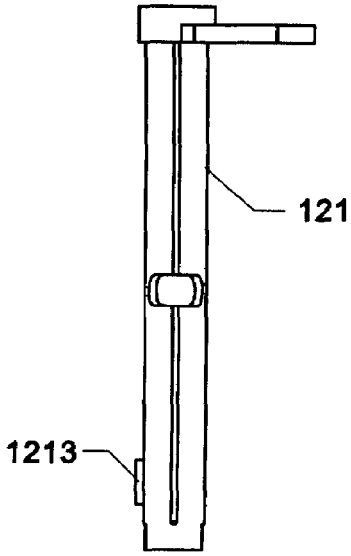
FIG. 38 is a right side view of FIG. 37.
Figure 37:
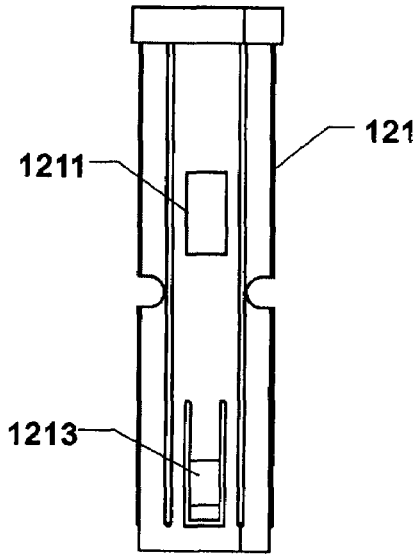
FIG. 37 is a schematic view that shows a left connecting component of the chair according to the invention.
Figure 39:
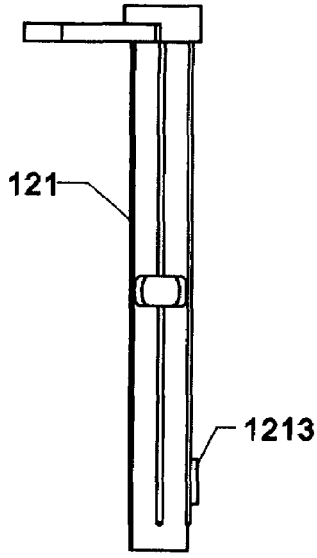
FIG. 39 is a left side view of FIG. 37.
Figure 41:
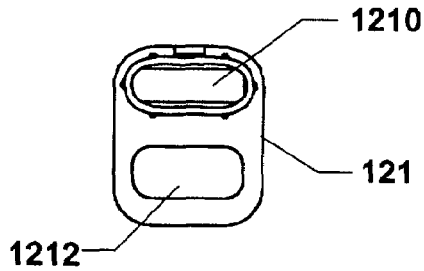
FIG. 41 is a bottom view of FIG. 37.
Figure 45:
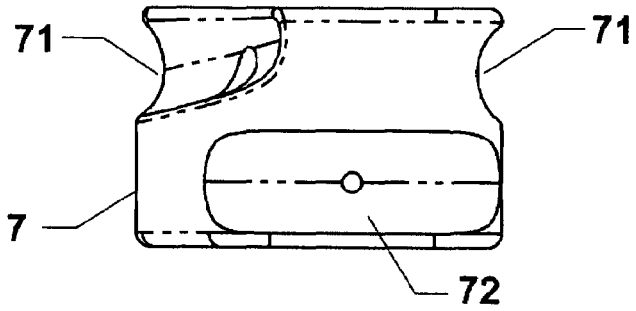
FIG. 45 is a top view of FIG. 42.
Figure 43:
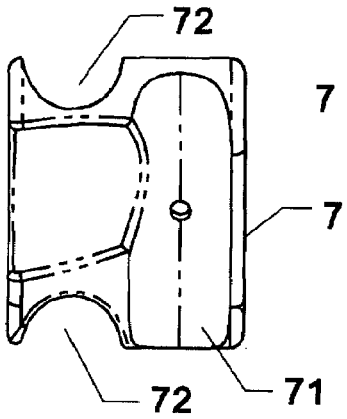
FIG. 43 is a left side view of FIG. 42.
Figure 42:
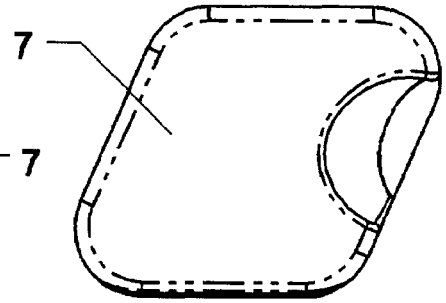
FIG. 42 is a schematic view that shows a left stacking block of the chair according to the invention.
Figure 44:
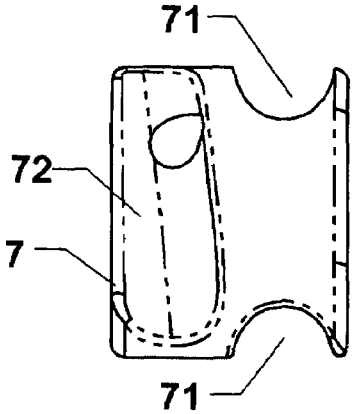
FIG. 44 is a right side view of FIG. 42.
Figure 46:
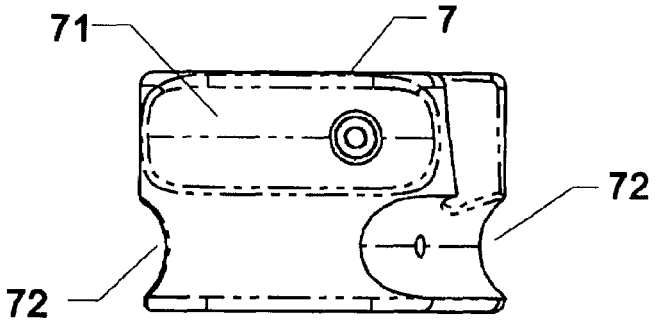
FIG. 46 is a bottom view of FIG. 42.
Figure 50:
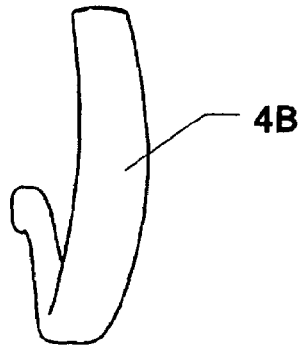
FIG. 50 is a top view of FIG. 47.
Figure 48:
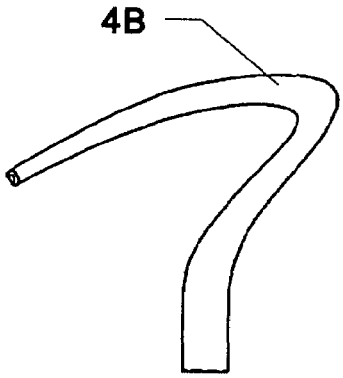
FIG. 48 is a left side view of FIG. 47.
Figure 47:
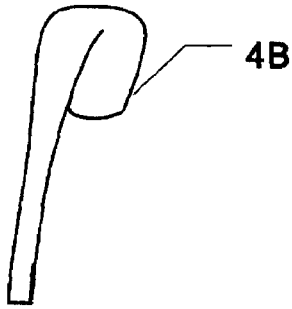
FIG. 47 is a schematic view that shows a right armrest of the chair according to the invention.
Figure 49:
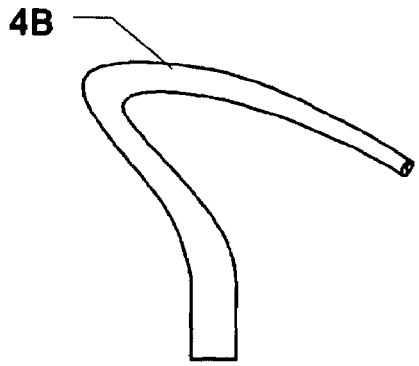
FIG. 49 is a right side view of FIG. 47.
Figure 51:
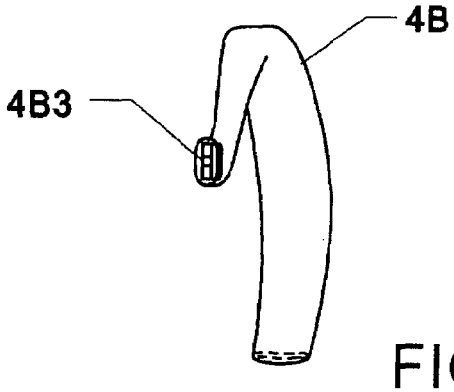
FIG. 51 is a bottom view of FIG. 47.
Figure 56:
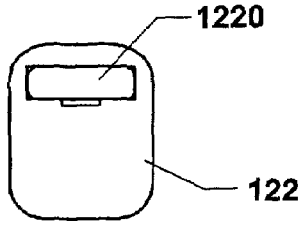
FIG. 56 is a bottom view of FIG. 52.
Figure 53:
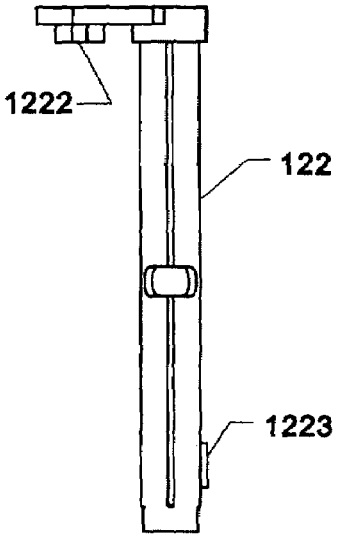
FIG. 53 is a right side view of FIG. 52.
Figure 52:
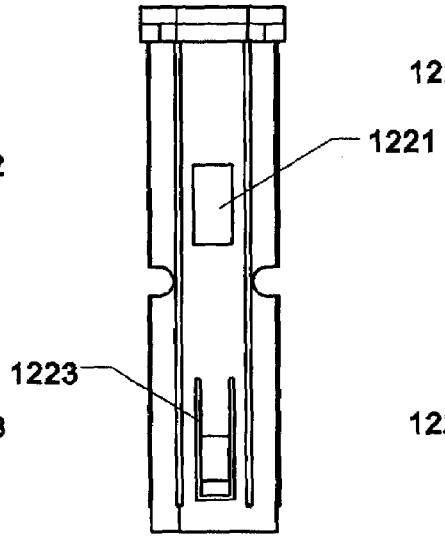
FIG. 52 is a schematic view that shows a right connecting component of the chair according to the invention.
Figure 54:
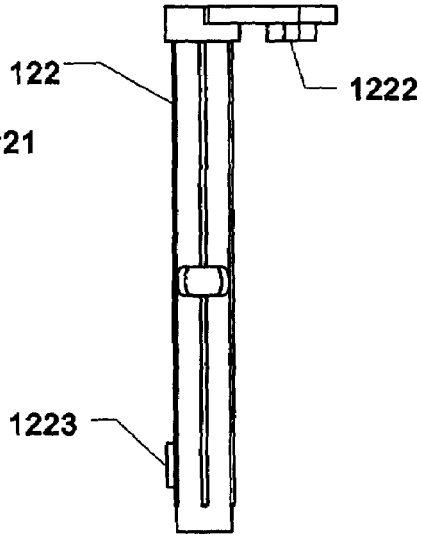
FIG. 54 is a left side view of FIG. 52.
Figure 55:
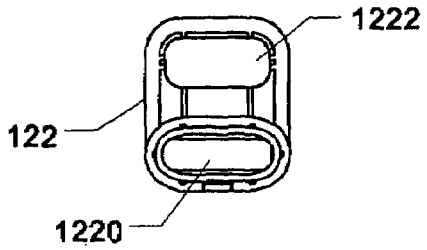
FIG. 55 is a top view of FIG. 52.
Figure 60:
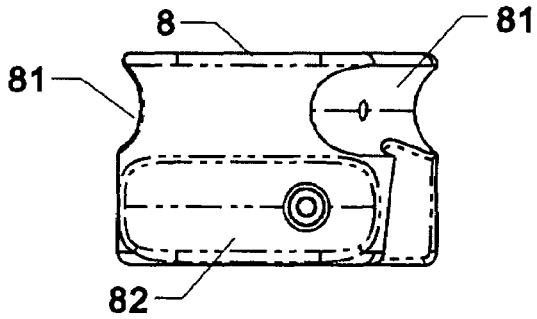
FIG. 60 is a top view of FIG. 57.
Figure 58:
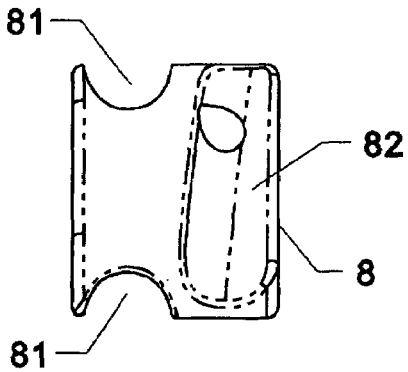
FIG. 58 is a left side view of FIG. 57.
Figure 57:
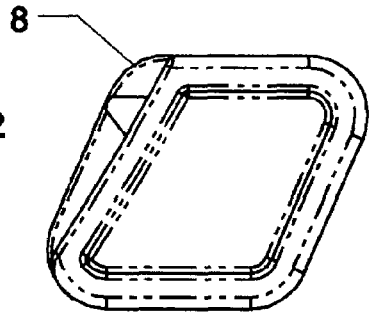
FIG. 57 is a schematic view that shows a right stacking block of the chair according to the invention.
Figure 59:
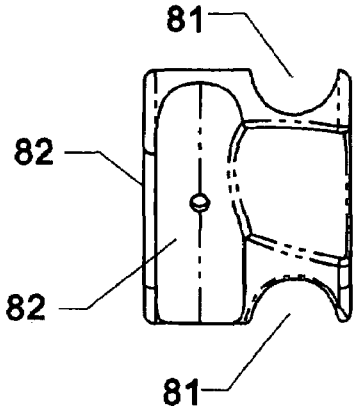
FIG. 59 is a right side view of FIG. 57.
Figure 61:
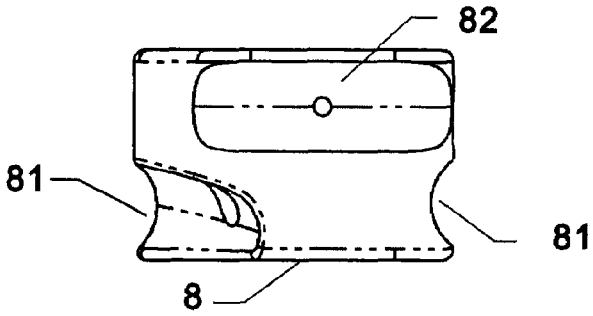
FIG. 61 is a bottom view of FIG. 57.
Figure 63:
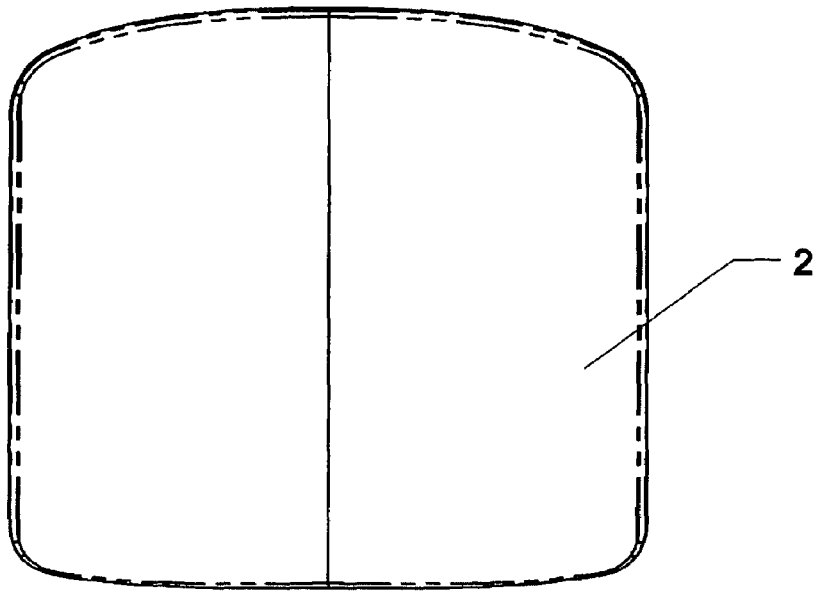
FIG. 63 is a top view of FIG. 62.
Figure 62:
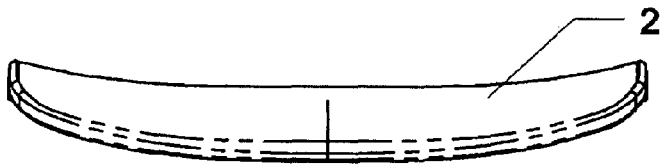
FIG. 62 is a schematic view that shows a seat of the chair according to the invention.
Figure 64:
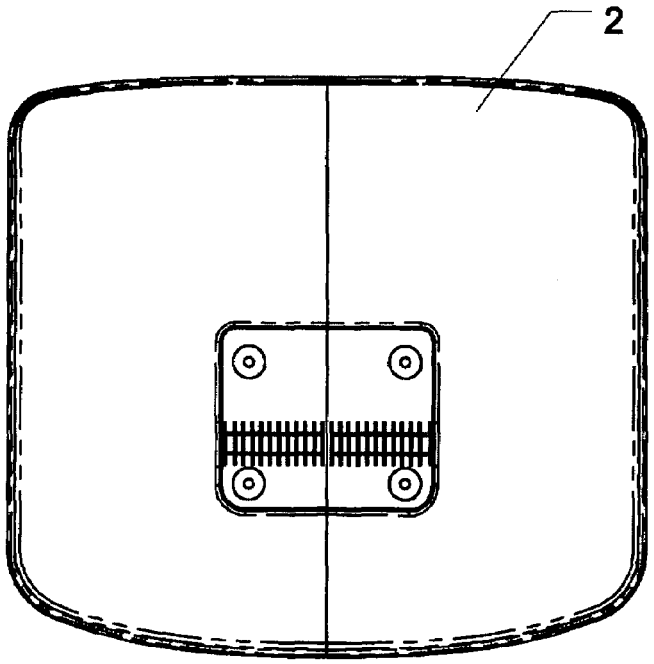
FIG. 64 is a bottom view of FIG. 62.
Figure 65:
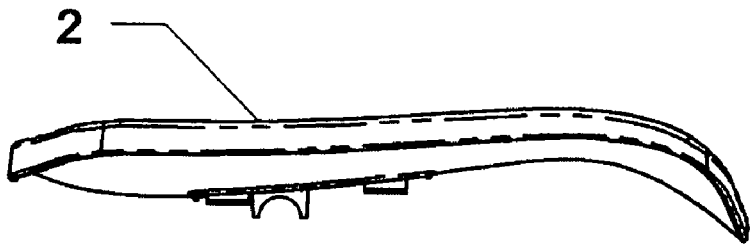
FIG. 65 is a left side view of FIG. 62.
Figure 66:
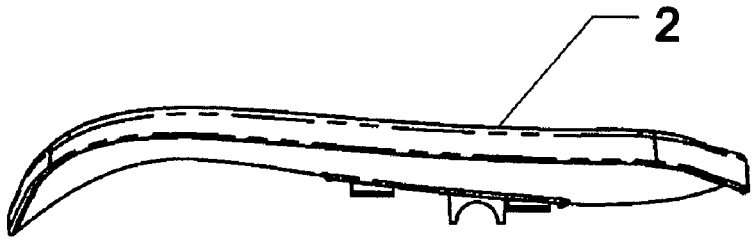
FIG. 66 is a right side view of FIG. 62.
Figure 67:
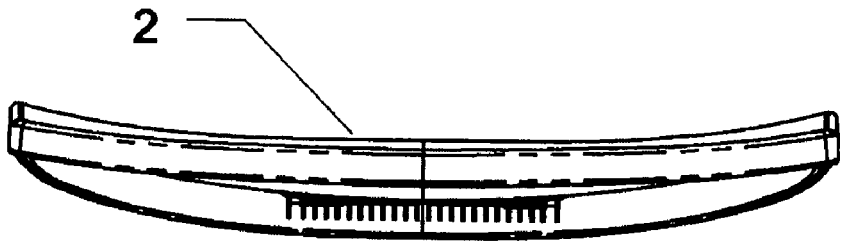
FIG. 67 is a rear view of FIG. 62.
Figure 69:
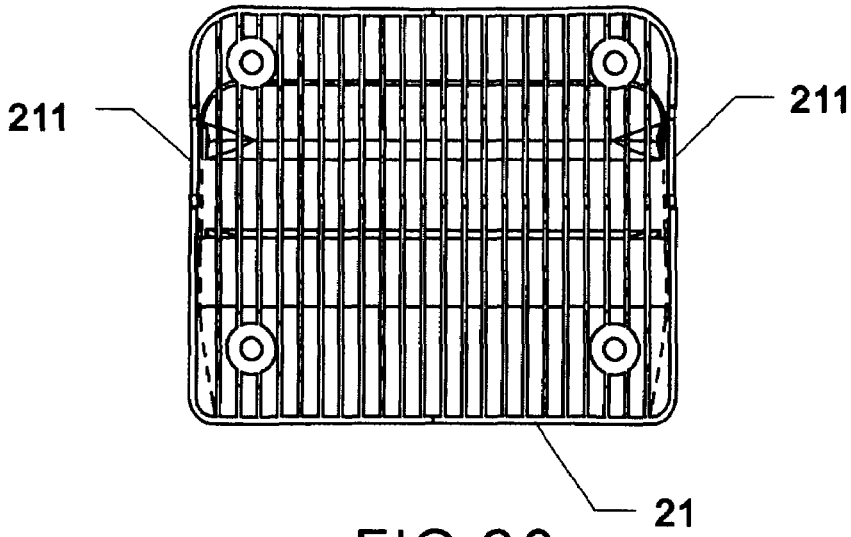
FIG. 69 is a top view of FIG. 68.
Figure 68:
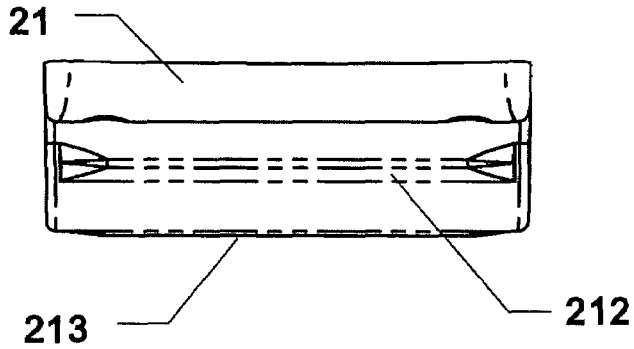
FIG. 68 is a schematic view that shows a seat turning mechanism of the chair according to the invention.
Figure 70:
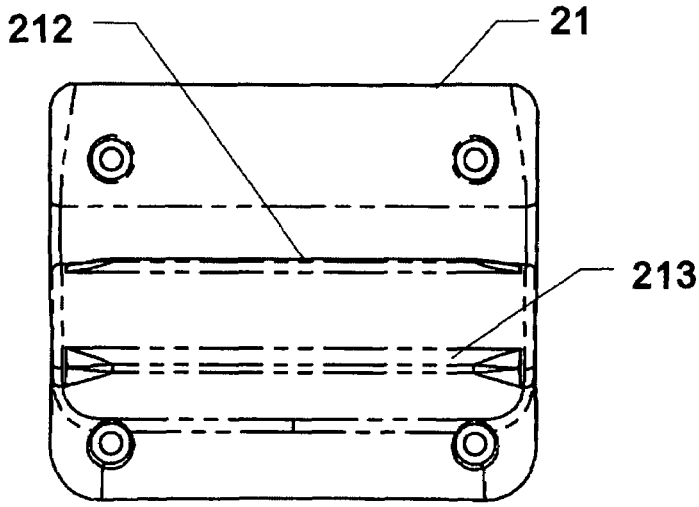
FIG. 70 is a bottom view of FIG. 68.
Figure 72:
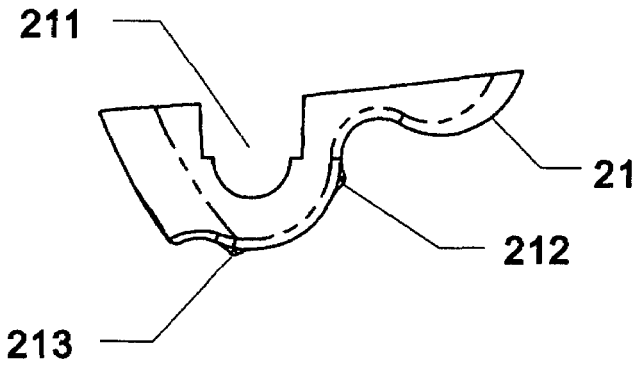
FIG. 72 is a left side view of FIG. 68.
Figure 71:
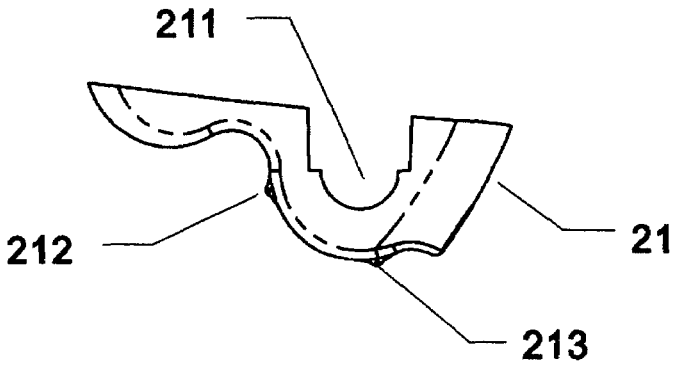
FIG. 71 is a right side view of FIG. 68.
Figure 73:
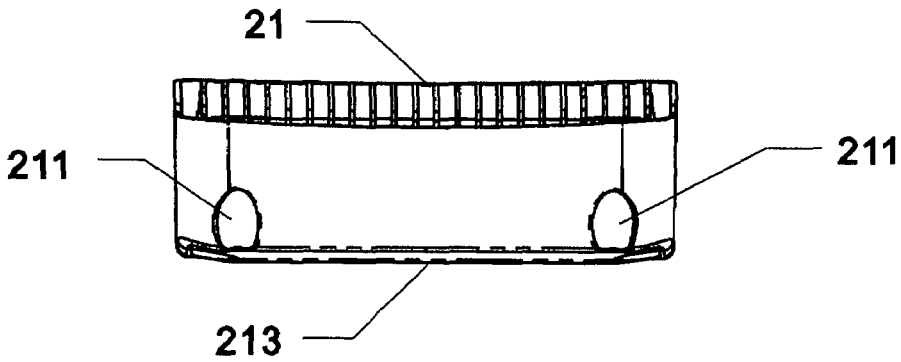
FIG. 73 is a rear view of FIG. 68.
Figure 77:
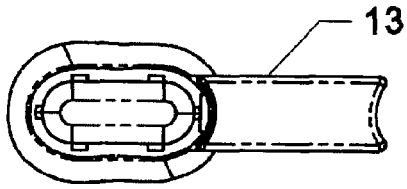
FIG. 77 is a top view of FIG. 74.
Figure 75:
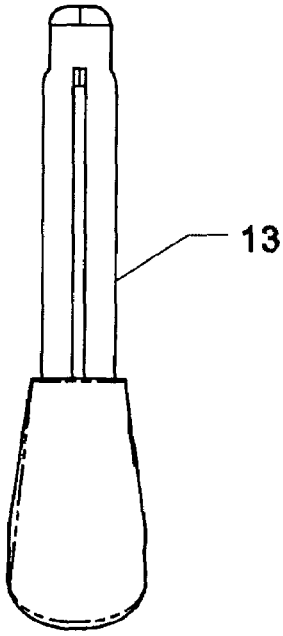
FIG. 75 is a left side view of FIG. 74.
Figure 74:
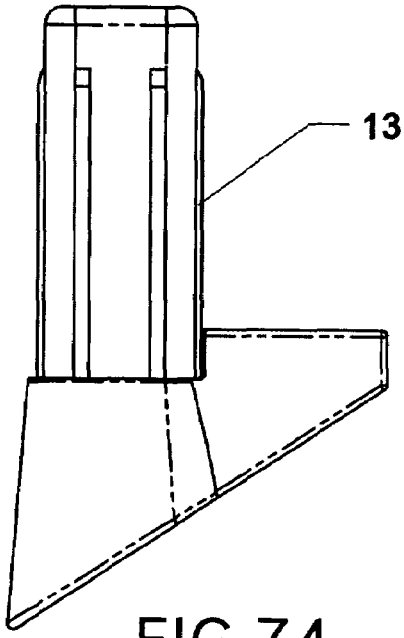
FIG. 74 is a schematic view that shows a stopper of the chair according to the invention.
Figure 76:
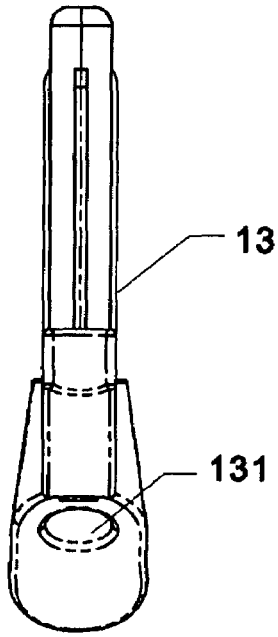
FIG. 76 is a right side view of FIG. 74.
Figure 78:
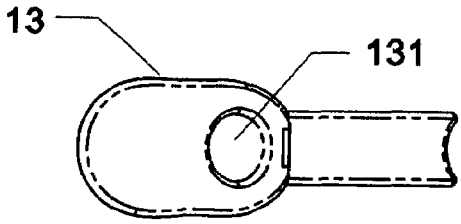
FIG. 78 is a bottom view of FIG. 74.

Referring to FIGS. 42 to 46, which show a left stacking block (7) disposed at junctions between the left frontal support and the left rear support, and FIGS. 57 to 61, which show a right stacking block (8) disposed at junctions between the right frontal support and the right rear support. The stacking blocks (7) and (8) are rhombus-shaped, and the stacking block (7) has grooves for frontal supports (71) formed at an upper frontal plane and at a lower rear plane on an inner side thereof, as well as grooves for rear supports (72) formed at a lower frontal plane and at an upper rear plane on an outer side thereof. Similarly, the right stacking block (8) has grooves for frontal supports (81) formed at an upper frontal plane and at a lower rear plane on an inner side thereof, as well as grooves for rear supports (82) formed at a lower frontal plane and at an upper rear plane on an outer side thereof. Therefore, regardless of whether the chairs are stacked horizontally as shown in FIGS. 3 and 4 or vertically as shown in FIGS. 5 and 6, the grooves (71), (72), (81), and (82) of the left and the right stacking blocks (7), (8) allow and facilitate the chairs to be stacked safely and stably.

The chair assembly capable of being stacked vertically and horizontally according to the invention has advantages as follows:

1. Allowing the chairs with the structure to be stacked either horizontally or vertically.
2. Allowing the chairs to be aligned and connected together in an orderly manner via the hooks and slots disposed at two sides of the frame of the chairs.
3. The disposition of the stacking blocks allows the chairs to be stacked together safely and stably in both horizontal stacking and vertical stacking.
4. The chair assembly capable of being stacked vertically and horizontally of the invention is simple and facilitates the storage of the chairs.
5. The chair assembly of the invention allows a large number of chairs to be arranged easily by anyone.
6. The chair assembly of the invention achieves high cost-effectiveness in regard to the usage of the chairs.

Although a preferred embodiment of the invention has been described for purposes of illustration, it is understood that various changes and modifications to the described embodiment can be carried out without departing from the scope and the spirit of the invention as disclosed in the appended claims.

What is claimed is:

1. A chair assembly capable of being stacked vertically and horizontally, comprising a frame, a turnable seat assembled with the frame, as well as a backrest and armrests assembled with the frame; wherein the frame is comprised of two frontal supports and two rear supports; an assembling shaft horizontally disposed within the frame for holding and allowing the seat to be turned, a positioning rod disposed parallel to the assembling shaft for allowing the seat to be turned upward or downward and keeping the seat upturned or downturned; a chair resulted from combining the frame, the backrest, the armrests, and the turnable seat together may be stacked either vertically or horizontally; and wherein the seat and the assembling shaft (5) are assembled together via a seat turning mechanism (21) disposed underneath the seat; the seat turning mechanism includes a trough (211) therein for receiving the assembling shaft horizontally, and the seat turning mechanism also includes protruding stripes at an outer surface thereof; and wherein a distance between a center of the trough and an outer surface of each of the external protruding stripes in the seat turning mechanism is greater than a distance between a center of the assembling shaft and an outer surface of the positioning rod;

wherein stacking blocks (7, 8) are disposed at junctions between the frontal supports (11) and the rear supports (12) on both left and right sides of the frame; and wherein each of the stacking block disposed at near a junction between a respective frontal support and a respective rear support is rhombus-shaped, and each stacking block has a groove at a front upper side for receiving a respective frontal support and another groove at a rear upper side for receiving a respective rear support.

2. The chair assembly of claim 1, wherein the frame is formed by combining the two frontal supports and the two rear supports together, and a width between the two frontal supports is smaller than a width between the two rear supports.

3. The chair assembly of claim 1, wherein the frontal and the rear supports of the frame are disposed with stoppers at bottom ends thereof, respectively; each stopper include at lest one assembling opening disposed at a bottom surface thereof.

4. The chair assembly of claim 1, wherein the assembling shah is horizontally disposed between the two rear supports of the frame for holding and allowing the seat to be turned, and the positioning rod parallel to the assembling shaft is disposed between the two frontal supports of the frame so that the seat is turnable upwards or downwards and keeps the scat upturned or downturned.

5. The chair assembly of claim 1, wherein the frame and the backrest are assembled together via a retaining component disposed at a lateral side of an upper portion of the two frontal supports, respectively; while retaining holes are disposed on two lateral tubes of the backrest for the retaining component to fit into.

6. The chair assembly of claim 1, wherein the two rear supports have a left connecting component and a right connecting component securely disposed into upper portions thereof, respectively; the left and the right connecting components are assembled with the left and the right armrests, respectively; both the left and the right connecting components include a channel therein for receiving inserting parts of the left and the right armrests, and each of the channels has a retaining hole at a lateral wall thereof for receiving and retaining parts on the inserting parts of the armrests.

7. The chair assembly of claim 6, wherein the inserting parts of the left and the right armrests are disposed in lower openings of the left and the right arm rests.

8. The chair assembly of claim 6, wherein for the left and the right connecting components disposed at left and right side of the two rear supports, one of the connecting components include a slot at an outer side thereof, while another connecting component includes a book at an outer side thereof.

9. The chair assembly of claim 6, wherein for the left and the right connecting components disposed at left and right side of the two rear supports, one of the connecting components includes a retaining part disposed on a side thereof for being fitted into the rear supports.

* * * * *